US006520890B2

(12) United States Patent
Hsu

(10) Patent No.: US 6,520,890 B2
(45) Date of Patent: Feb. 18, 2003

(54) MODULAR BODY BUILDER FRAME BOX

(76) Inventor: Hank Hsu, Linkuo Ind., Park II, No. 4, Keng 9 Rd., Linkuo Hsian, Taipei Hsien (TW)

( * ) Notice: Subject to any disclaimer, the term of this patent is extended or adjusted under 35 U.S.C. 154(b) by 0 days.

(21) Appl. No.: 09/899,166

(22) Filed: Jul. 6, 2001

(65) Prior Publication Data

US 2003/0008751 A1 Jan. 9, 2003

(51) Int. Cl.[7] ..... A63B 22/02
(52) U.S. Cl. ..... 482/54; 482/51
(58) Field of Search ..... 482/54, 51, 904, 482/61–62, 66, 148, 142, 140

(56) References Cited

U.S. PATENT DOCUMENTS 3,874,657 A * 4/1975 Niebojewski ..... 272/58
4,431,181 A * 2/1984 Baswell ..... 272/62
5,813,947 A * 9/1998 Densmore ..... 482/51
6,224,516 B1 * 5/2001 Disch ..... 482/54

* cited by examiner

*Primary Examiner*—Jerome W. Donnelly
*Assistant Examiner*—Lori Baker Amerson
(74) *Attorney, Agent, or Firm*—Browdy and Neimark, P.L.L.C.

(57) ABSTRACT

A modular body builder frame box is of a rectangular construction and is capable of being rested securely on a ground surface or against a wall. The frame box has a receiving compartment extending from a front side thereof toward a rear side thereof. The receiving compartment is provided in two side walls with a pivoting recess in proximity of the bottom of the receiving compartment. The pivoting recess is used for pivoting a predetermined part of a body building device such that the body building device can be swiveled between a standby position and a storage position, and that the body building device is rested on a ground surface at such time when the body building device is located at the standby position, and further that the body building device is contained in the receiving compartment of the frame box at such time when the body building device is located at the storage position.

5 Claims, 9 Drawing Sheets

MODULAR BODY BUILDER FRAME BOX

FIELD OF THE INVENTION

The present invention relates generally to a body building device, and more particularly to a modular body builder frame box.

BACKGROUND OF THE INVENTION

In light of time and space limitations, most people resort to the indoor exercise devices to keep them physically fit. The commonly used indoor exercise devices include jogging machine, walking machine, exercise vehicle, rowing machine, weight-lifting devices, etc. In addition, the exercise devices are foldable to facilitate storage and transportation of the exercise devices. For example, the jogging platform of the jogging machine is foldable. However, the conventional foldable exercise machines are defective in design in that the folded exercise machines are still cumbersome to obstruct the space available for a variety of activities, and that the folded exercise machines have an external appearance which undermines the overall aesthetic integrity of a room in which they are kept.

SUMMARY OF THE INVENTION

The primary objective of the present invention is to provide a modular body builder frame box which is designed for use in pivoting and containing a body building device in such a manner that the folded device takes up a very small space, and that the folded device coordinates harmoniously with an indoor space.

In keeping with the principle of the present invention, the foregoing objective of the present invention is attained by a modular body builder frame box which is of a rectangular construction and can be fixed on a surface or onto a wall. The frame box has a receiving compartment extending from the front of the frame box toward the rear of the frame box. The receiving compartment is provided in the left and the right side walls with a pivoting recess located in proximity of the bottom of the receiving compartment. A body builder can be pivoted with the pivoting recess of the frame box such that the body builder can be swiveled between a standby position and a storage position. When the body builder is in the standby position, the body builder is securely rested on the floor surface and is ready for service. When the body builder is in the storage position, the body builder is contained in the receiving compartment of the frame box.

DETAILED DESCRIPTION OF THE INVENTION

Figure 1:
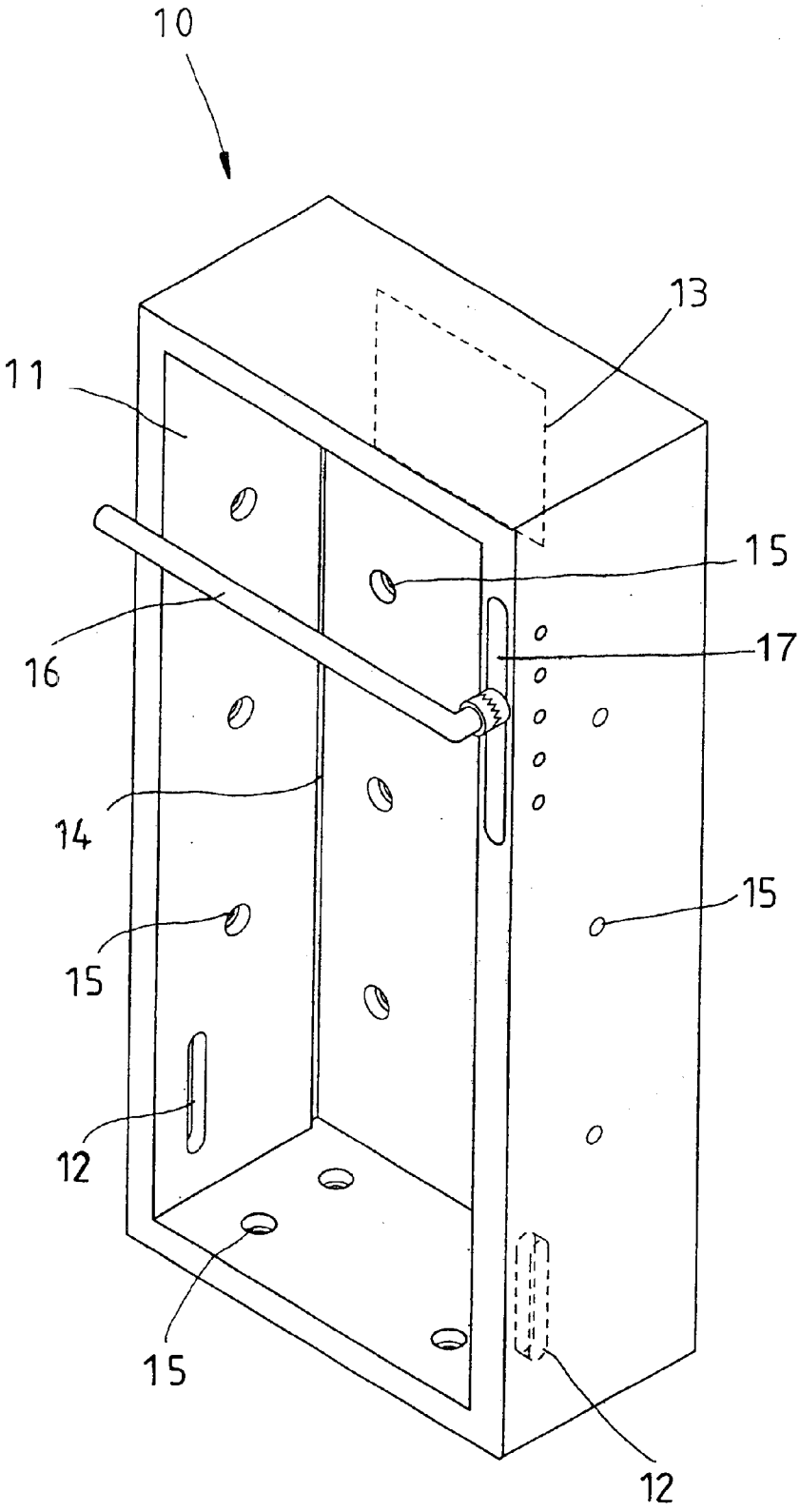
FIG. 1 shows a perspective view of a first preferred embodiment of the present invention.
Figure 2:
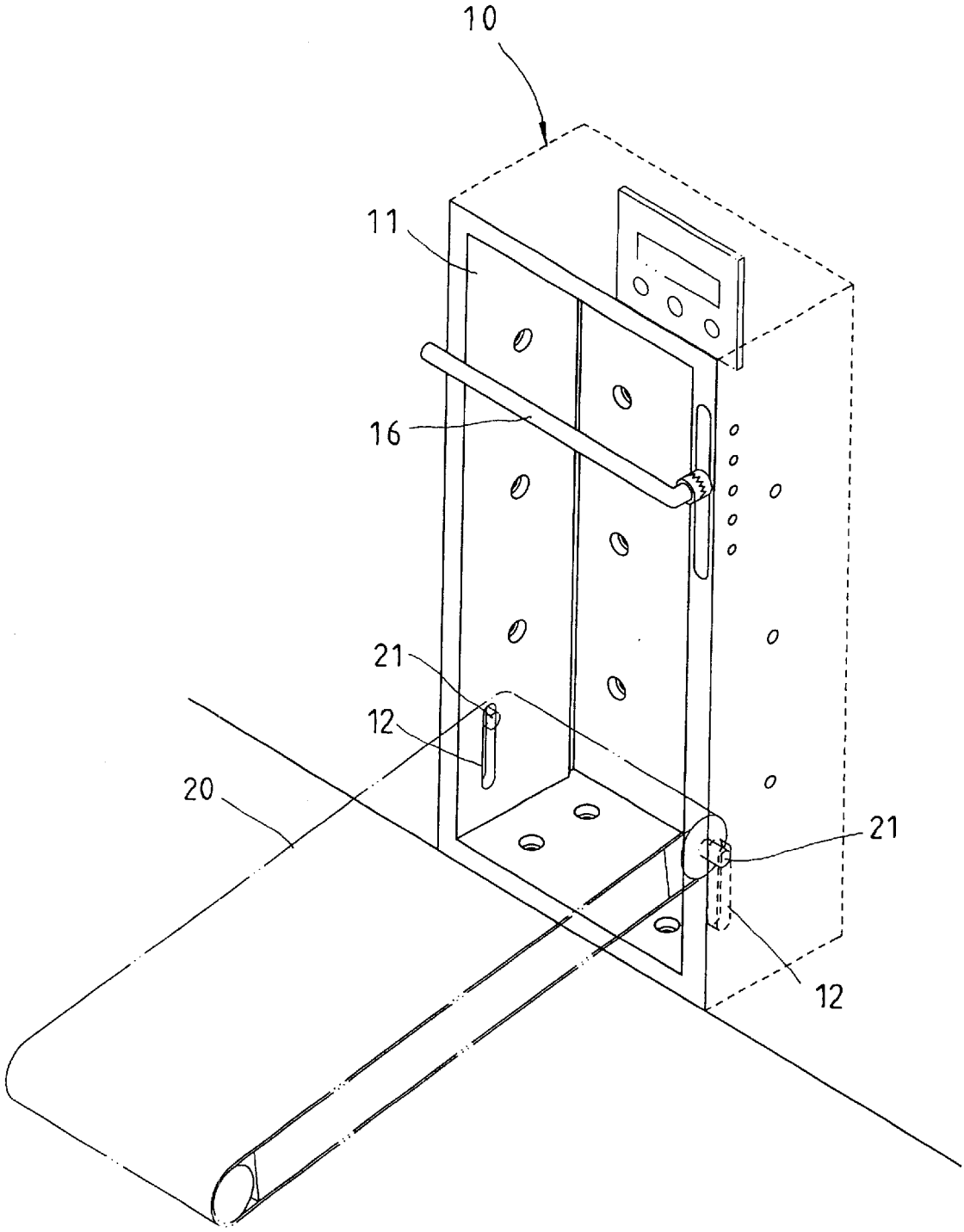
FIG. 2 is a schematic view of the preferred embodiment of the present invention in the state of application, with the jogging platform being located at a slanted standby position.

As shown in FIG. 1, a modular frame box 10 embodied in the present invention is made of metal and rectangular in shape. The frame box 10 is provided with a rectangular receiving compartment 11 extending from the front thereof toward the rear thereof. The compartment 11 is provided in the left and the right side walls with a pivoting recess 12 which is a longitudinally-oriented slot and is located in proximity of the bottom thereof. The compartment 11 is provided in a higher position of the inner wall thereof with a fixation frame 13. One of the side walls of the compartment 11 is provided with a wire slot 14 extending upwards and downwards. The top end of the wire slot 14 is connected to the fixation frame 13. The frame box 10 is provided in the back, two sides, and the underside with a plurality of through holes 15. The frame box 10 is provided in the front side with a rail rod 16 of an L-shaped construction, with one end of the short side being movably disposed at the side edge of the frame box 10 to slide along a slot 17 of the frame box 10 and to locate at a predetermined height, thereby allowing a person to pull it out and then swivel it. Upon being let go, it retracts automatically to locate at that angle. The long side of the rail rod 16 is horizontally located at the front of the opening, as shown in FIG. 1.

As shown in FIGS. 2–5, the present invention is held securely in place on a ground surface, or fixed to a wall such that the back of the frame box 10 is embedded in the wall, and that the front (the opening of the compartment 11) is flush with the wall surface, and further that the underside is level with the ground surface. The frame box 10 may be fixed with the wall or the ground surface by a plurality of rivets, which are fastened onto the wall or ground surface via the through holes 15.

Figure 3:
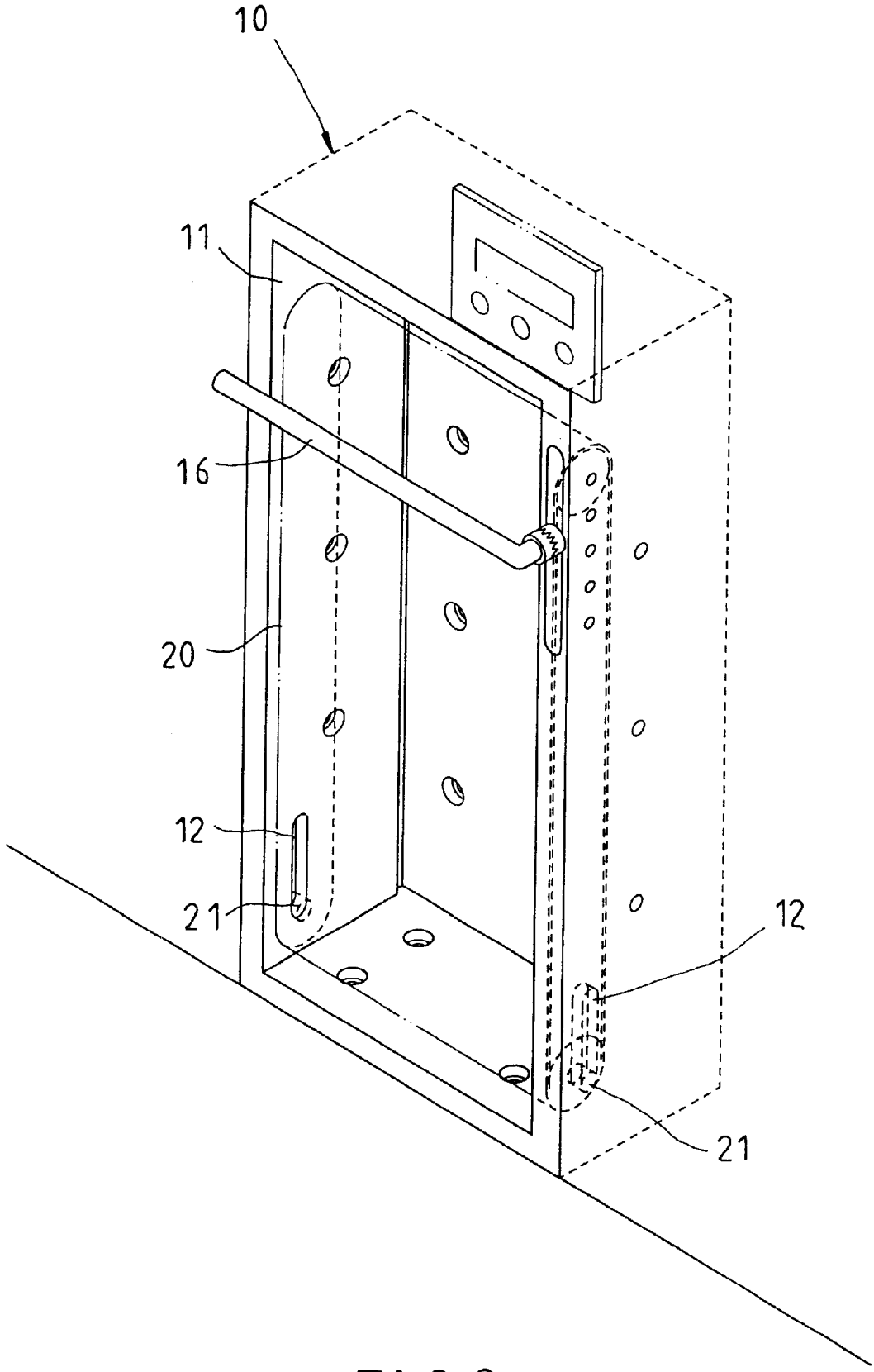
FIG. 3 is a schematic view of the preferred embodiment of the present invention in the state of application, with the jogging platform being located at the storage position.
Figure 4:
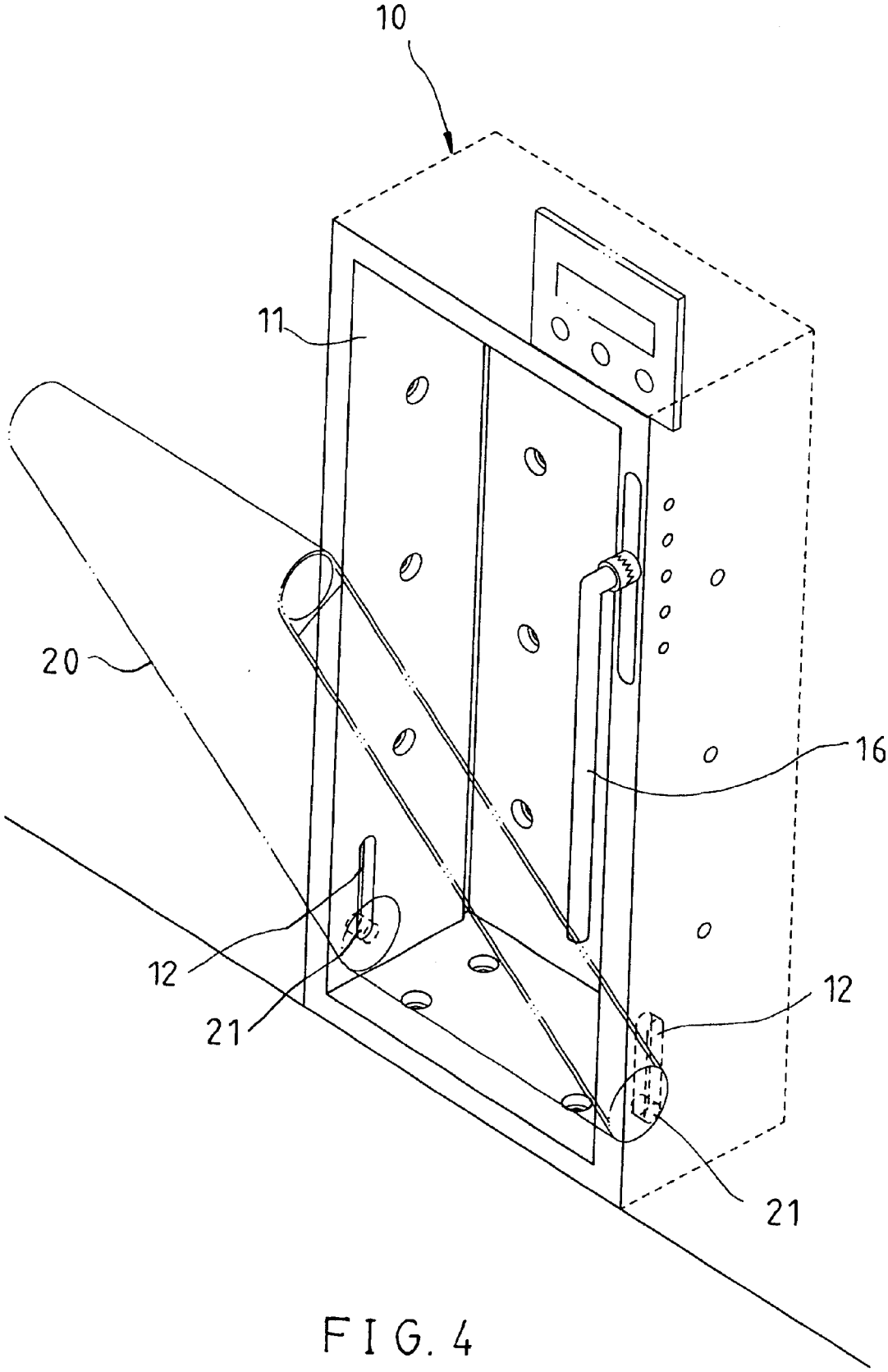
FIG. 4 is a schematic view of the preferred embodiment of the present invention in the state of application, with the jogging platform being located between the standby position and the storage position.
Figure 5:
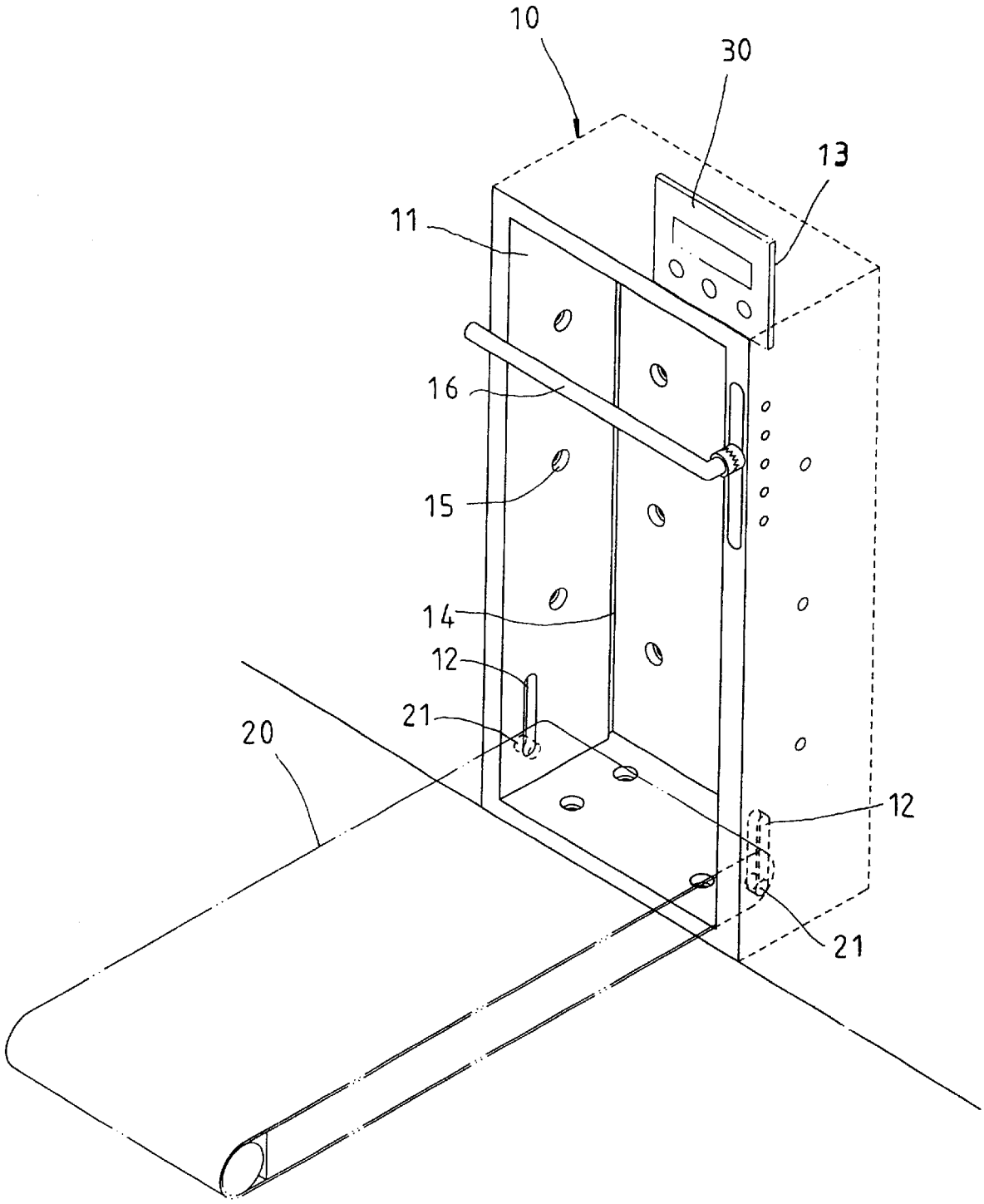
FIG. 5 is a schematic view of the preferred embodiment of the present invention in the state of application, with a jogging platform being located at a horizontal standby position.

An exercise device is pivoted at a predetermined part thereof in the compartment 11. For example, a jogging platform 20 on which an endless belt is provided. The platform 20 is provided in two sides of the front end thereof with a protruded shaft 21, which is pivoted to the pivoting recess 12 of the compartment 11, thereby enabling the platform 20 to swivel on the shaft 21 between a horizontal standby position, as shown in FIG. 5, and an upright storage position, as shown in FIG. 3. When the swiveling is started, the shaft 21 is located at the lowest end of the pivoting recess 12. When the jogging platform 20 is swiveled from the standby position to the storage position, the rail rod 16 must be temporarily swiveled to remain in the longitudinal state, so as to keep the front opening of the receiving compartment 11 clear, as shown in FIG. 4.

When the jogging platform 20 is located at the standby position, its rear end is rested on the ground surface such that its front end is capable of sliding up and down along the allowable range of the pivoting recess 12 and is capable of locating at a predetermined height, thereby enabling the jogging platform 20 to be slanted at various inclinations. As shown in FIG. 5, the protruded shaft 21 is located at the bottommost end of the pivoting recess 12. As a result, the jogging platform 20 is horizontally located. Now referring to FIG. 2, the protruded shaft 21 is shown to be located at the highest end of the pivoting recess 12, the jogging platform 20 is slanted in such a way that the front end of the jogging platform 20 is higher than the rear end of the jogging platform 20. While using the platform 20 for doing the jogging exercise, a user holds the rail rod 16 which can be adjusted in height to suit the need of the user. Moreover, the fixation frame 13 of the receiving compartment 11 is provided therein within an electronic display 30 which is connected to the jogging platform 20 by a wire. The wire is received in the wire slot 14. The display 30 exhibits the operational state of the jogging platform 20, such as revolving speed of the belt, the jogging distance, the jogging duration, etc.

As shown in FIG. 3, the jogging platform 20 is located at the storage position such that the platform 20 is entirely contained in the receiving compartment 11 of the frame box 10, and that the platform 20 is secured in place, and further that the rail rod 16 is kept in the horizontal position to rest against the outer side of the platform 20, so as to prevent the platform 20 from slipping out.

Figure 6:
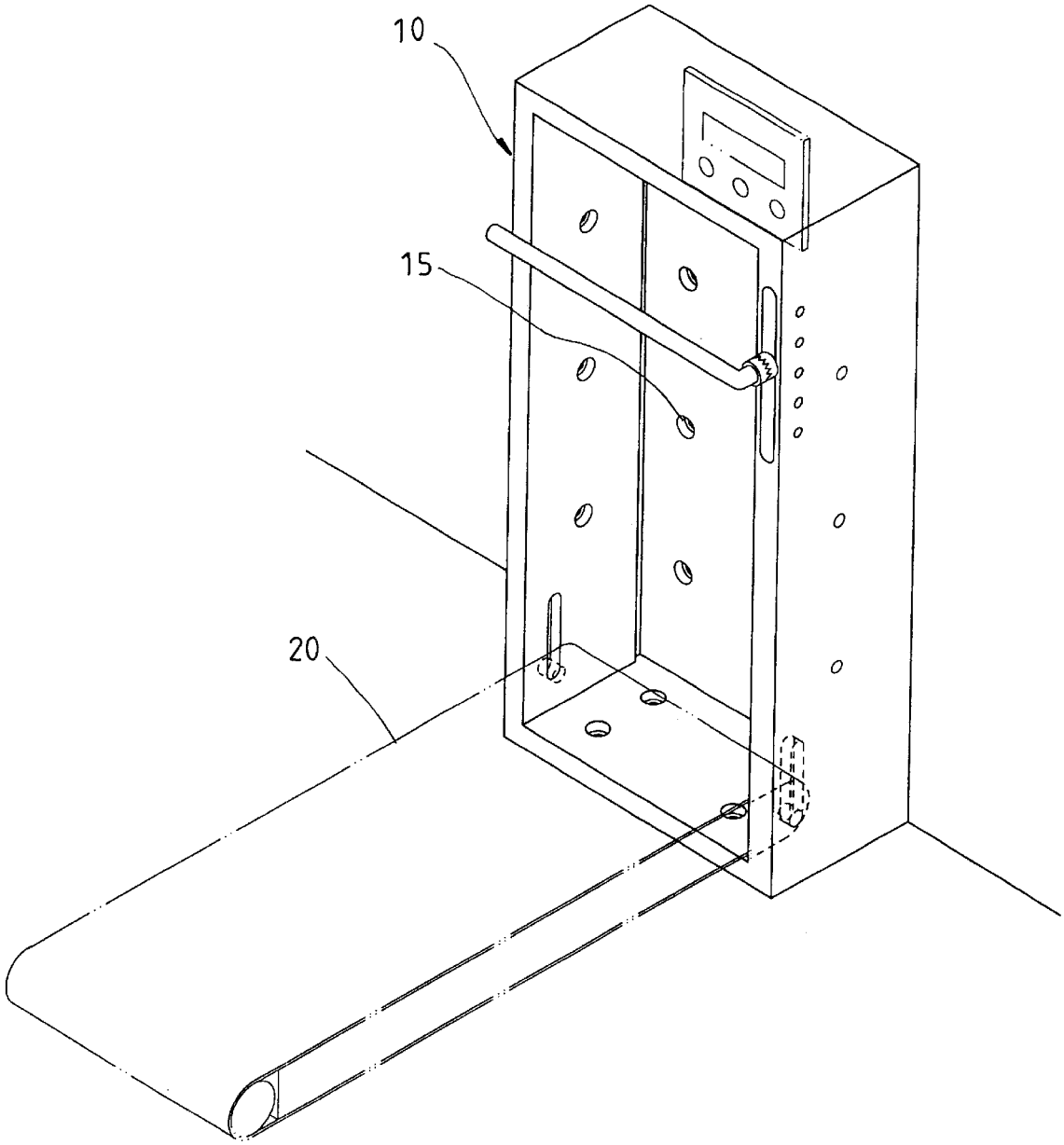
FIG. 6 shows a schematic view of the first preferred embodiment of the present invention in another state of application.

As shown in FIG. 6, the frame box 10 is fixed at the back thereof with a wall surface by a plurality of nails.

Figure 7:
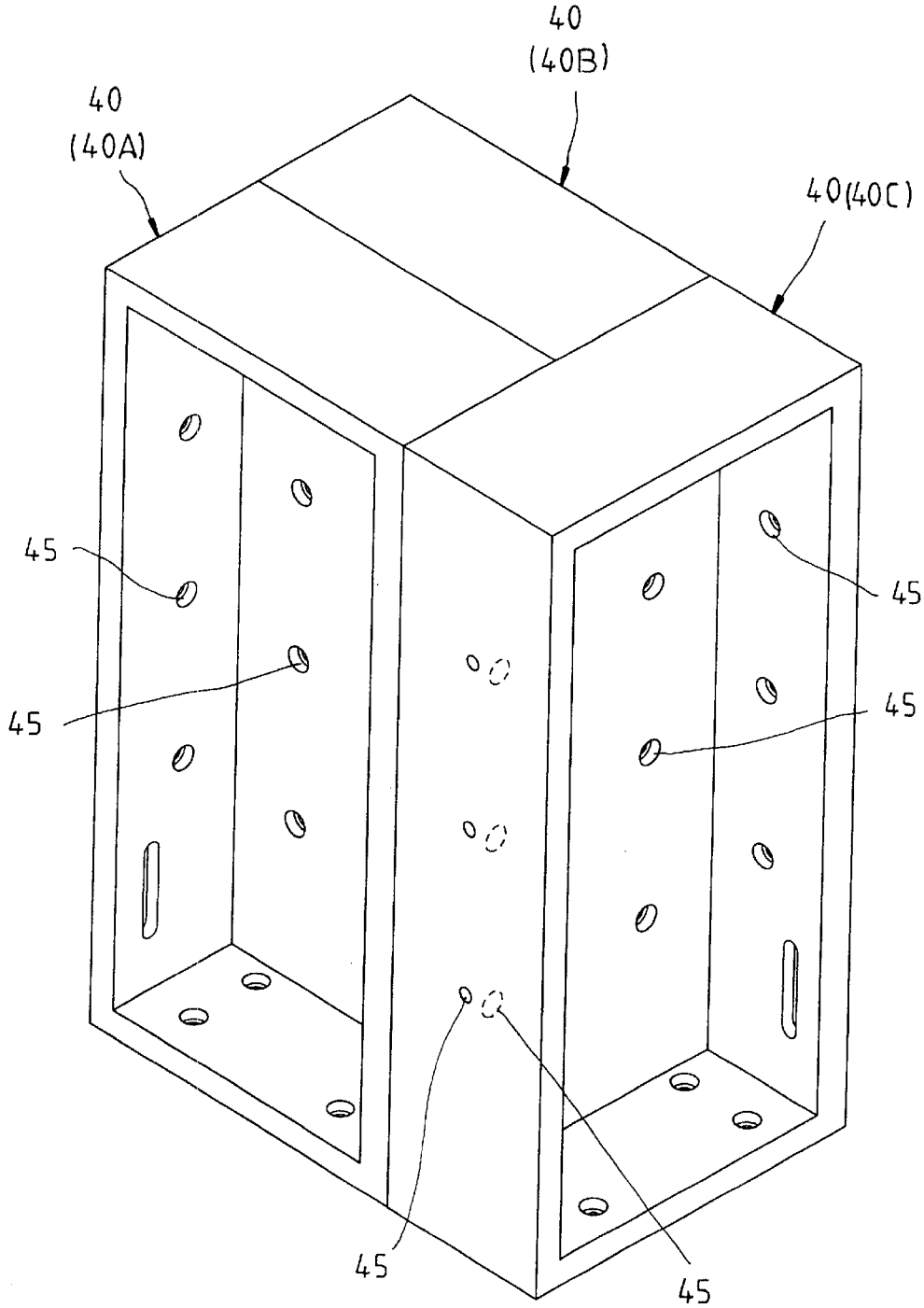
FIG. 7 shows a schematic view of a module of a second preferred embodiment of the present invention.
Figure 8:
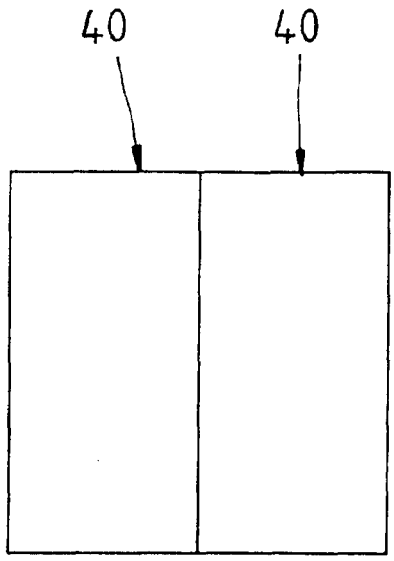
FIGS. 8–11 are top views of various modules of the second preferred embodiment of the present invention.
Figure 9:
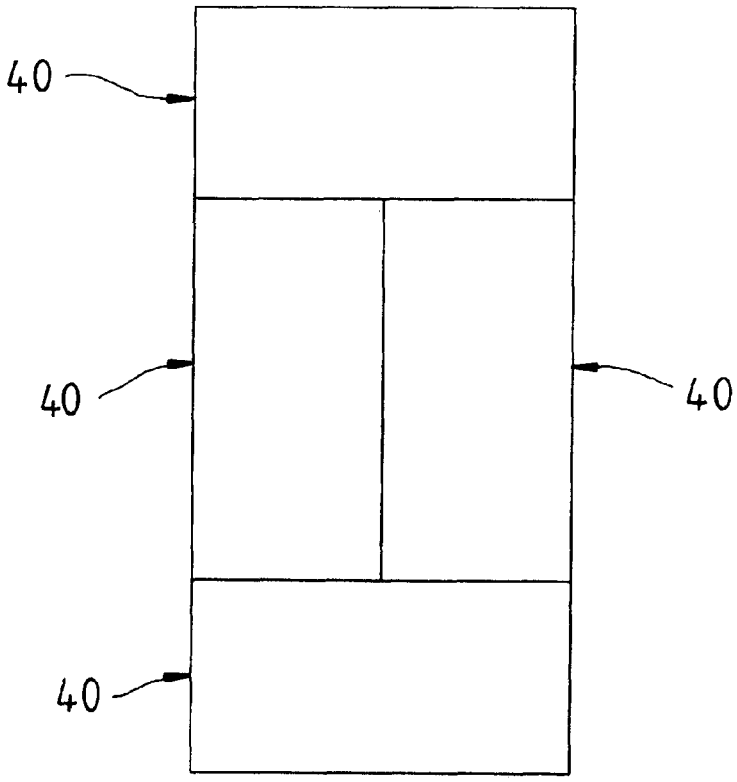
Figure 10:
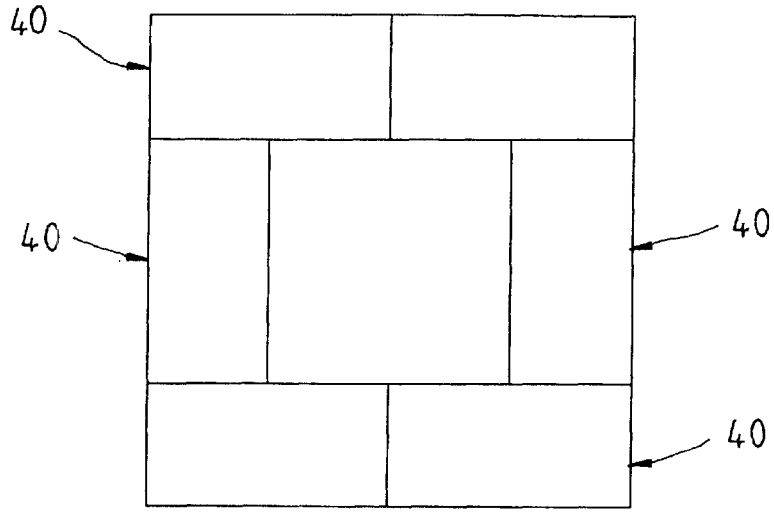
Figure 11:
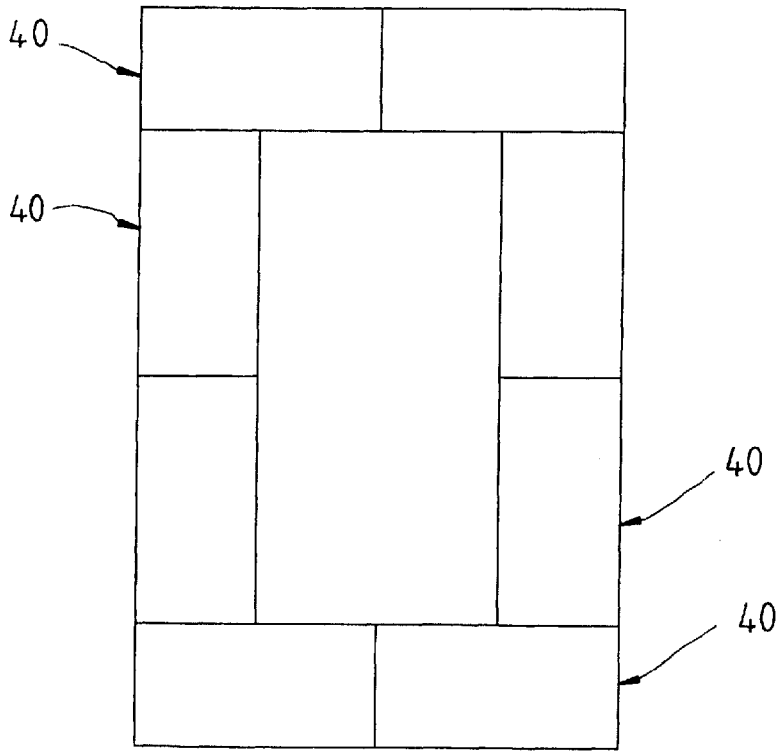

As shown in FIG. 7, a modular frame box 40 of the second preferred embodiment of the present invention is similar in construction to that of the first preferred embodiment described above. The second preferred embodiment is characterized by the frame box 40 which is provided in the back and the two sides with a plurality of fisheye through holes 45 for accommodating a nut or bolt. As a result, a plurality of units of the frame box 40 can be joined together, as illustrated in FIG. 7 in which three units are joined together such that the back sides of two frame boxes 40A and 40B are rested against each other, and that their through holes 45 are aligned, and further that a third unit 40C is rested at the back side thereof against the same side of the units 40A and 40B, with the back through hole 45 being aligned with the side through holes 45*b* of the frame boxes 40A and 40B. The three units are fastened together by a plurality of bolts which are put through the through holes 45. Similarly, four or more units of the frame box of the present invention can be joined together, as illustrated in FIGS. 8, 9, 10 and 11. The frame box 40 of the present invention is compatible with a variety of exercise devices, such as walking machine, exercise vehicle, rowing machine, massaging bed, weight-lifting machine, etc.

What is claimed is:

1. A modular body builder frame box of a rectangular construction adapted to be engaged to a ground surface or against a wall, comprising a framebox, said frame box having a receiving compartment extending from a front side thereof toward a rear side thereof, said receiving compartment being provided in two side walls with a pivoting recess in proximity of a bottom of said receiving compartment, a shaft of a body building device being rotatably engaged in the pivoting recess so that the body building device can be rotated between a standby position and a storage position, and that the body building device rests on a ground surface when the body building device is located in the standby position, and further that the body building device is contained in said receiving compartment of said frame box at such time when the body building device is located in the storage position;

wherein said frame box is provided on an outer edge of one of the two side walls with a rail rod having a horizontal position in front of an opening of said receiving compartment and is movably connected with said frame box such that said rail rod is temporarily prevented from obstructing the opening of said receiving compartment when the body building device is being swiveled between the standby position and the storage position, wherein the rail rod automatically returns to the horizontal position when released after being moved, said rail rod being pressed against the outer side of the body building device when the body building device is located in the storage position and serves as a support for a user when exercising; and wherein said rail rod can slide up and down in a slot in the outer edge and can be fixed at a predetermined height.

2. The frame box as defined in claim 1, wherein said receiving compartment of said frame box is provided with a fixation frame for mounting an electronic display to exhibit the operating state of the body building device; wherein said frame box is provided in the wall with a wire slot extending longitudinally for receiving a wire connecting said display with the body building device.

3. The frame box as defined in claim 1, wherein said frame box is provided in the back and two sides with a plurality of through holes for receiving a plurality of bolts which are used in conjunction with nuts to fasten a plurality of said frame boxes together such that the back sides or the sides of said frame boxes are pressed against one another.

4. The frame box as defined in claim 1, wherein said frame box is provided in the wall and the underside with a plurality of through holes for receiving nails which are used to fix said frame box to a wall or ground surface.

5. The frame box as defined in claim 1, wherein said pivoting recess is a longitudinally-oriented slot enabling the shaft of the body building device to displace longitudinally along said slot.

* * * * *